US005238152A

United States Patent [19]

Maas et al.

[11] Patent Number: 5,238,152

[45] Date of Patent: Aug. 24, 1993

[54] QUICK-LOCKING CHILD RESISTANT BOTTLE CAP ASSEMBLY

[75] Inventors: Wilhelmus J. J. Maas; Petrus L. W. Hurkmans, both of Someren, Netherlands

[73] Assignee: AFA Products Inc., Forest City, N.C.

[21] Appl. No.: 840,784

[22] Filed: Feb. 24, 1992

[51] Int. Cl.[5] ..... B67B 5/00

[52] U.S. Cl. ..... 222/153; 215/274; 222/383

[58] Field of Search ..... 222/1, 153, 321, 380, 222/383, 385; 215/274, 221

[56] References Cited

U.S. PATENT DOCUMENTS

| | | | |
|---|---|---|---|
| 3,693,820 | 9/1972 | Linkletter | 215/274 X |
| 3,737,077 | 6/1973 | Bruce et al. | 222/153 |
| 4,073,398 | 2/1978 | Schultz | 215/274 X |
| 4,346,821 | 8/1982 | Wesner et al. | 215/274 X |
| 4,366,921 | 1/1983 | Kirk, Jr. | 222/153 |
| 4,434,916 | 3/1984 | Ruscitti et al. | 222/321 |
| 4,538,745 | 9/1985 | Dunning et al. | 222/153 |
| 5,072,860 | 12/1991 | Dobbs et al. | 222/383 |
| 5,097,990 | 3/1992 | Goncalves | 222/153 |

*Primary Examiner*—Kevin P. Shaver
*Attorney, Agent, or Firm*—Thomas R. Vigil

[57] ABSTRACT

The child resistant trigger sprayer bottle cap/bottle neck assembly comprises a trigger sprayer having a body including a cylindrical base. First coupling structure in the form of at least one deflectable tab with an opening therein is incorporated into the cylindrical base for coupling to a bottle neck. Second coupling structure in the form of a locking lug is provided on a bottle neck and is adapted to engage and couple with the first coupling structure by reason of the lug being received in the opening in the tab. There is also provided a locking ring which is received over the cylindrical base mounted on the neck for maintaining the first and second coupling structures in a coupled locked position.

68 Claims, 4 Drawing Sheets

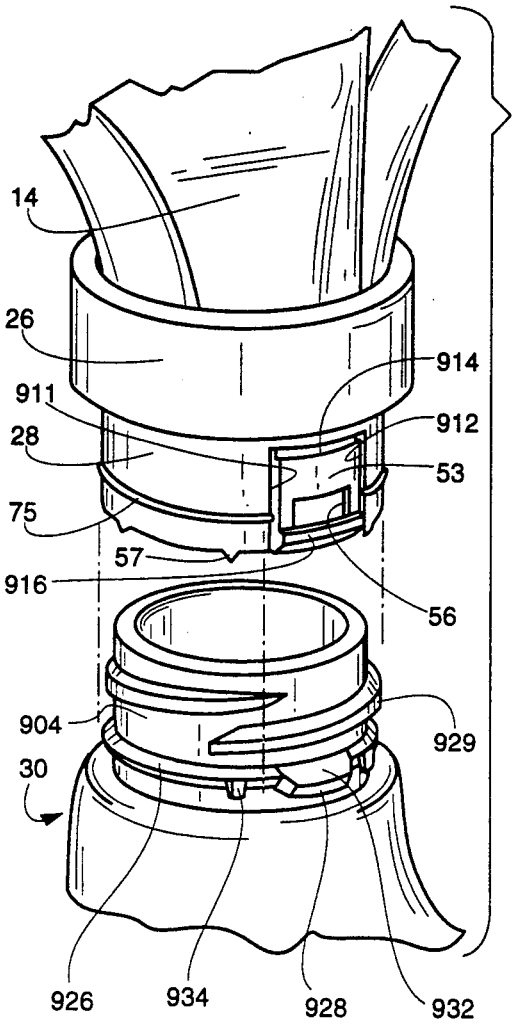
FIG. 8
FIG. 9
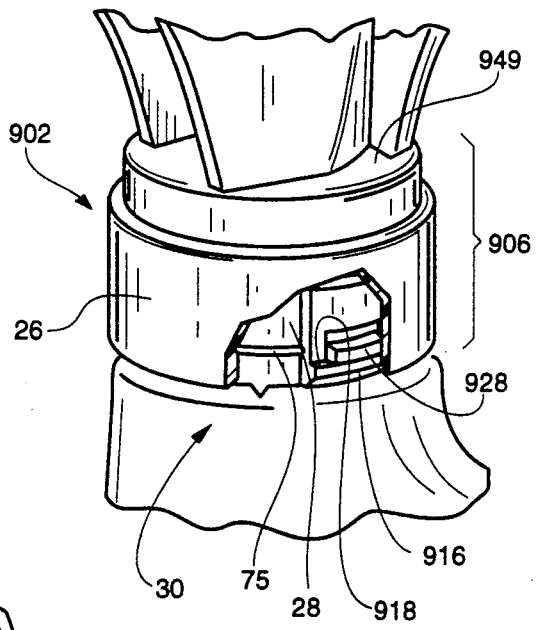
FIG. 10
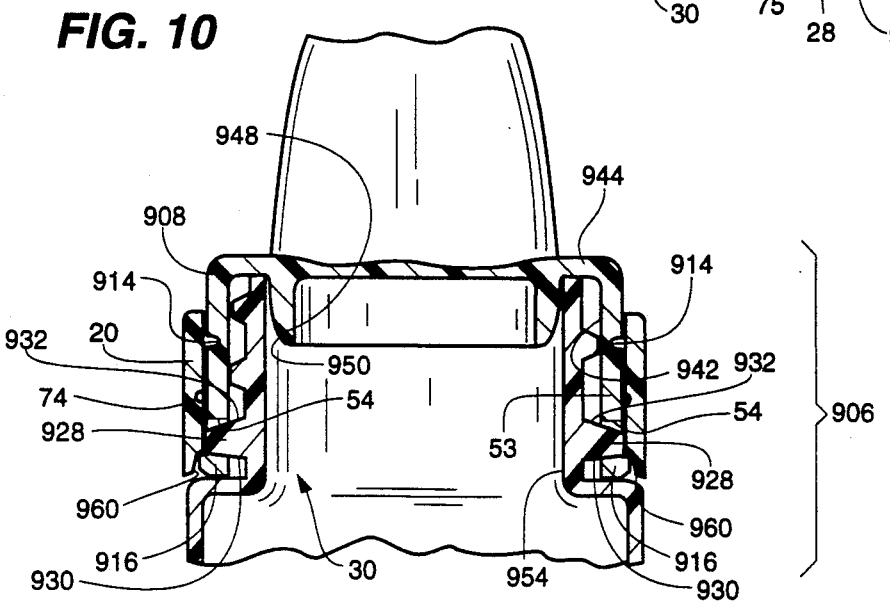

QUICK-LOCKING CHILD RESISTANT BOTTLE CAP ASSEMBLY

BACKGROUND OF THE INVENTION

1. Field of the Invention

The present invention relates to a trigger operated fluid dispensing device for mounting to a top neck of a bottle or similar liquid storage container.

More specifically, the present invention relates to a quick-locking and child resistant bottle cap assembly for coupling a trigger sprayer type discharging device to the top of the liquid storage container.

This bottle cap assembly is easy to install and cannot be dislodged by accident, for example, by a playing child and therefore ensures a child resistant bottle cap coupling arrangement.

2. Description of the related art including information Disclosed under 37 CFR §1.97–1.99.

Heretofore various types of bottle cap assemblies, such as for trigger sprayers, have been proposed. Some examples of these previously proposed bottle cap assemblies which are intended to be child resistant and some which may be used with trigger sprayers are disclosed in the following patents:

| U.S. Pat. No. | Patentee |
|---|---|
| 4,180,174 | Quinn |
| 4,454,965 | Kirk, Jr. |
| 4,781,311 | Dunning et al. |

In the Quinn U.S. Pat. No. 4,180,174 a child resistant threaded closure for a container is disclosed which includes a lower ring-like portion attached to the closure by retractable and extendable legs and having a matching thread. With the closure screwed in place on a container, the ring is pushed down by means of tabs to a position below the last thread on the container with the legs extended whereupon, when an attempt is made to unscrew the closure, the thread segment of the ring interferes with the last thread of the container and prevents its removal. For the closure to be removed, the ring is lifted up by finger pressure applied to the tabs until the legs are fully retracted and the threads match up with the other threads, after which action the closure can be unscrewed.

The Kirk, Jr. U.S. Pat. No. 4,454,965 discloses a child resistant trigger pump dispenser having an elongate, transverse oriented body section with a pump outlet at the end thereof and a vertically extending lower end section for receiving fluid from the container. The lower end section of the pump is equipped with a rigidly attached closure member having a multiplicity of short threads with projections on the inner wall of a downwardly depending skirt. The container neck is provided on its outside surface with a multiplicity of lock threads, some having recessed portions at their terminal ends to receive the projections on the skirt of the closure member. The closure member is provided with an upstanding boss which is received in an opening provided in the lower portion of the body member for accommodating a trigger arm whereby the longitudinal or major axis of the trigger pump can be oriented with respect to the engaging short threads provided on the closure member.

The Dunning et al. U.S. Pat. No. 4,781,311 discloses a cap closure for sealing the opening to a container. The top neck of the container has either external threads or an external annular bead fastener, and vertical stop walls. The cap closure has an outer annular skirt and inwardly projecting lugs which are adapted to pass over the threads or bead fastener with axial pressure and to abut the walls upon closure while an annular inner skirt seals the top neck of the container. The lugs must be so designed as to spring past the threads or bead fastener when the cap is applied to the neck using axial pressure. The cap closure can be snapped on and off and twisted on and off when the fastening means are external threads and the walls are located diametrically opposite each other so that they abut the lugs in opposite directions relative to the neck. Upon closure, the top side of each lug interfaces with the under surface of the external threads. Depending on the extent of the interfacing, the cap may also be snapped off.

The bottle cap assembly of the present invention is significantly different from the prior Quinn, Kirk, Jr. and Dunning et al. cap closures.

As will be described in greater detail hereinafter, the bottle cap assembly of the present invention comprises a cap closure with a cylindrical base, one or more snap-in assemblies formed in the cylindrical base, each including a resilient locking tab with an opening for receiving a corresponding snap-in lug on the container neck, and a locking ring which is received over the locking lugs for locking the cap closure on the container neck.

SUMMARY OF THE INVENTION

According to the invention there is provided a child resistant trigger sprayer bottle cap/bottle neck assembly comprising: a trigger sprayer having a body including a cylindrical base; first coupling structure incorporated into the cylindrical base for coupling to a bottle neck; a bottle neck; second coupling structure on the bottle neck adapted to engage and couple with the first coupling structure; the first coupling structure comprising at least one locking tab formed in the cylindrical base and having structure for locking with the second coupling structure on the bottle neck; and, a locking ring received over the cylindrical base and the cylindrical neck for maintaining the first and second coupling structure in a coupled locked position.

Also according to the invention there is provided a trigger sprayer adapted to be coupled to a bottle neck of a liquid storage container, the trigger sprayer comprising a body including a cylindrical base having a cylindrical wall coupling structure incorporated into the cylindrical wall for coupling to as bottle neck, and a locking ring which is molded with the cylindrical base and which is detachably connected to the cylindrical base at a lower edge of the cylindrical wall of the cylindrical base.

Still further, according to the invention there is provided a method for locking a trigger sprayer to a bottle neck of a liquid storage container, the method comprising the steps of: providing at the lower end of a trigger sprayer a cylindrical base including a cylindrical wall; providing in the cylindrical wall first coupling structure for coupling with a bottle neck; providing on the bottle neck second coupling structure for coupling and locking with the first coupling structure; molding with the cylindrical base a locking ring which is detachably connected to the cylindrical base at a lower edge of the cylindrical wall of the cylindrical base; breaking the locking ring away from the cylindrical base and moving it upwardly on the cylindrical base; pushing the cylindrical base downwardly over the bottle neck until the first coupling structure couples and locks with the second coupling structure; and, pushing the locking ring downwardly over the cylindrical base and the coupled and locked first and second coupling structures.

BRIEF DESCRIPTION OF THE DRAWINGS

FIG. 8 is a perspective exploded view of the bottle neck, cylindrical base and locking ring positioned for coupling engagement.

FIG. 9 is a perspective view with portions broken away of the bottle cap/bottle neck assembly.

FIG. 10 is a fragmentary rear elevational view of the bottle cap/bottle neck assembly with portions broken away to show the bottle cap/bottle neck assembly in vertical section.

DESCRIPTION OF THE PREFERRED EMBODIMENT(S)

Figure 1:
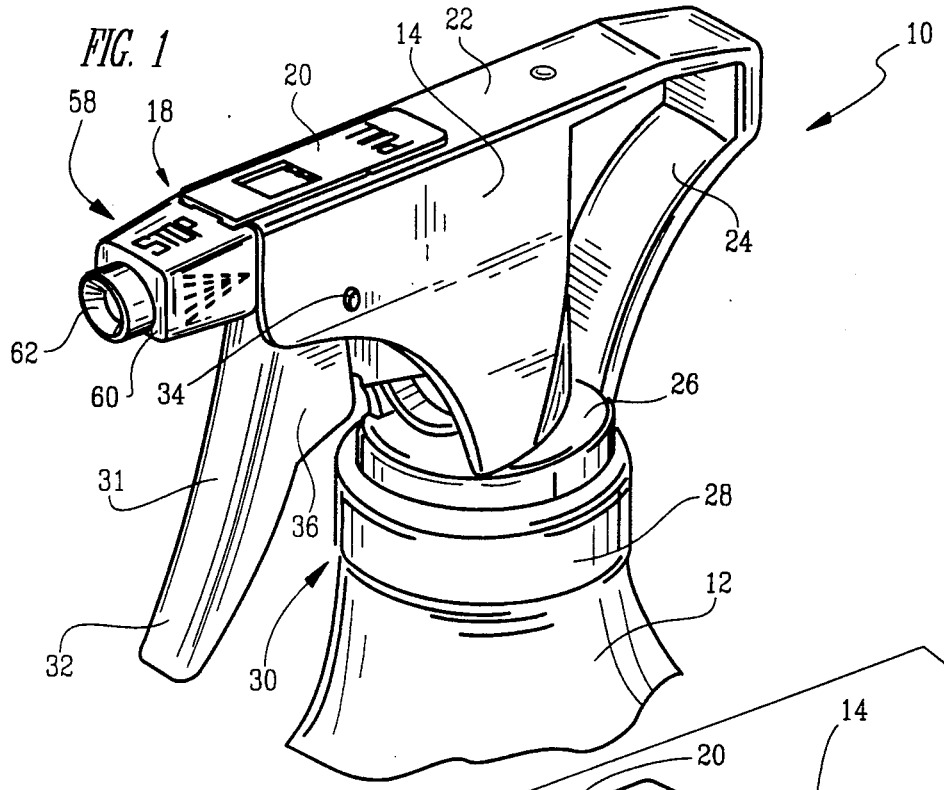
FIG. 1 is a perspective view of a trigger sprayer constructed according to the teachings of the present invention.

Referring now to the drawings in greater detail, there is illustrated in FIG. a perspective view of an all synthetic/plastic trigger sprayer 10 coupled to a bottle 12.

Figure 2:
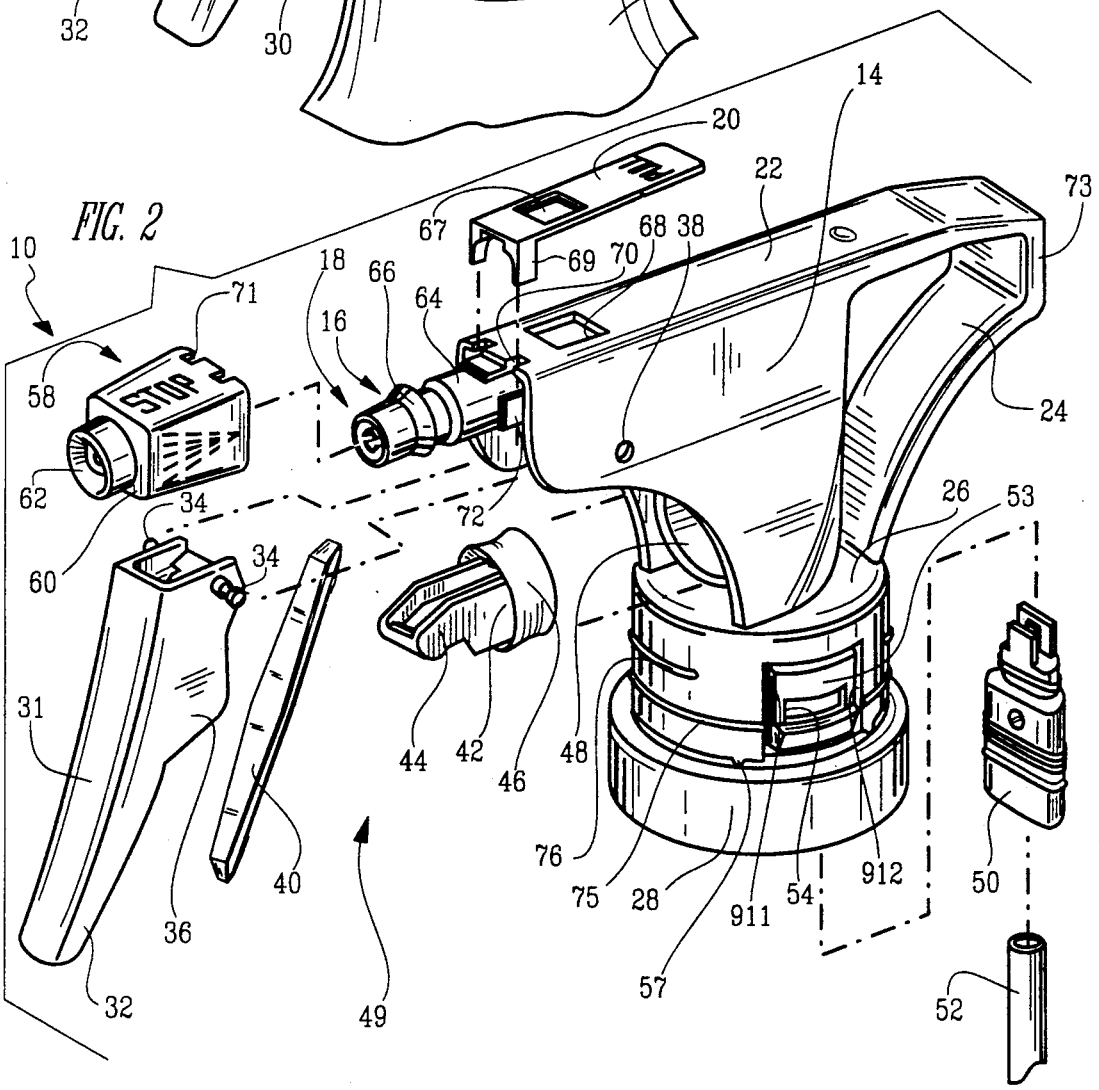
FIG. 2 is an exploded perspective view of the trigger sprayer shown in FIG. 1 and shows a locking ring prior to its detachment from a cylindrical base of the sprayer body.

An exploded perspective view of the parts of the trigger sprayer 10 is shown in more detail in FIG. 2.

The trigger sprayer 10 includes a body 14, a nose bushing 16 at a discharge end 18 of the body 14, a nozzle tamper proof or tamper evident pull away piece 20, a top portion 22 and a hand gripping formation 24 extending rearwardly from the top portion 22 of the body 14 and then downwardly to a cylindrical base 26 of the body 14. The base 26 is held by a locking ring 28 to a neck 30 of the bottle 12.

A trigger 32 having a front side 31 is pivotally mounted to the body 14 by having two cylindrical pins 34, molded on the top end of two opposed side walls 36 of the trigger 32, inserted into two corresponding holes 38 in the body 14 of the trigger sprayer 10.

As shown in FIG. 2, a plastic spring assembly 40 is placed between the body 14 and the trigger 32 to urge the trigger 32 always back into its home position. Coupled to the trigger 32 is a piston 42 having an outer piston rod 44 which connects with the trigger 32 and an inner cylindrical end 46 which is received in a cylindrical opening 48 in the body 14 for the purpose of varying the volume in a pumping chamber defined in the opening 48.

The trigger 32, the spring assembly 40, the piston 42 and the cylindrical opening 48 form and define primary components of a pumping mechanism 49.

A valve intake stem 50 is received into the bottom of the cylindrical base 26 and has a dip tube 52 releasably fixed thereto and depending therefrom for insertion into the bottle 12.

A safe and child resistant sprayer/bottle connection is provided and includes locking tabs 53 with lug receiving openings 54 formed in the cylindrical side wall of the cylindrical base 26 and cooperating locking lugs (928 in FIG. 10) on the bottle neck 30 and locked in place by the locking ring 28.

When the molded sprayer body is removed from a mold, the locking ring 28, connected to the cylindrical base 26 of the body 14 by six links, points, fillets or webs 57 which are necessary for molding the locking ring 28 together with the body 14 is broken away from the cylindrical base 26 by breaking the fillets 57 and moved upwardly on the base. During assembly of the parts of the trigger sprayer 10, the locking ring 28 is moved downwardly over the cylindrical base 26.

A nozzle assembly 58 is provided and includes a rotatable nozzle cap 60 having a forwardly extending cylindrical extension 62. The nozzle cap 60 is mounted on the nose bushing 16 extending from a cylindrical portion 64 of the body 14 and includes an annular band 66 for holding the nozzle cap 60.

Three different positions of the nozzle cap 60, a STOP position, a SPRAY position, and a STREAM position are provided.

When the nozzle assembly 58 is mounted to the body 14, a mounting block 67 of the piece 20 is snap fittingly received through an opening 68 in the top portion 22. At the same time, fork arms 69 of the piece 20 extend through notches 70 in the top portion 22 and/or notches 71 in the top wall of the cap 60 between one of two flexible locking legs or prongs 72 and the cylindrical portion 64 for securing the nozzle cap 60 in its STOP position, thereby ensuring a tamper proof and child resistant locking of the trigger sprayer nozzle assembly 58 to the body 14.

The nozzle assembly 58 is mounted on the discharge end 18 of trigger sprayer 10, as described above. The top portion 22 of the body 14 extends rearwardly to a rear end 73 of the hand gripping formation 24 and then slants forwardly and downwardly from the rear end 73 to the cylindrical base 26.

The six contact fillets or webs 57 are uniformly distributed around the lower end of the cylindrical base 26 and are initially integral with the locking ring 28. During the molding process, the contact fillets or webs 57 are broken and the locking ring 28 is moved upwardly relative to the cylindrical base 26. Later, when the locking ring 28 is moved downwardly on the base 26, an annular groove 74 within the locking ring 28 snap-fittingly mates with an annular rib 75 on the base 26. The upper position of the locking ring 28 is the pre-application-to-a-bottle position and the locking ring 28 is held in this position by frictional engagement of the inner wall of the locking ring 28 with the rib segments 76 provided on the outer cylindrical wall of the cylindrical base 26. The upper, partially annular rib segments 76 on the outer cylindrical wall of the cylindrical base 26 locate and to some extent limit upward movement of the locking ring 28.

Figure 3:
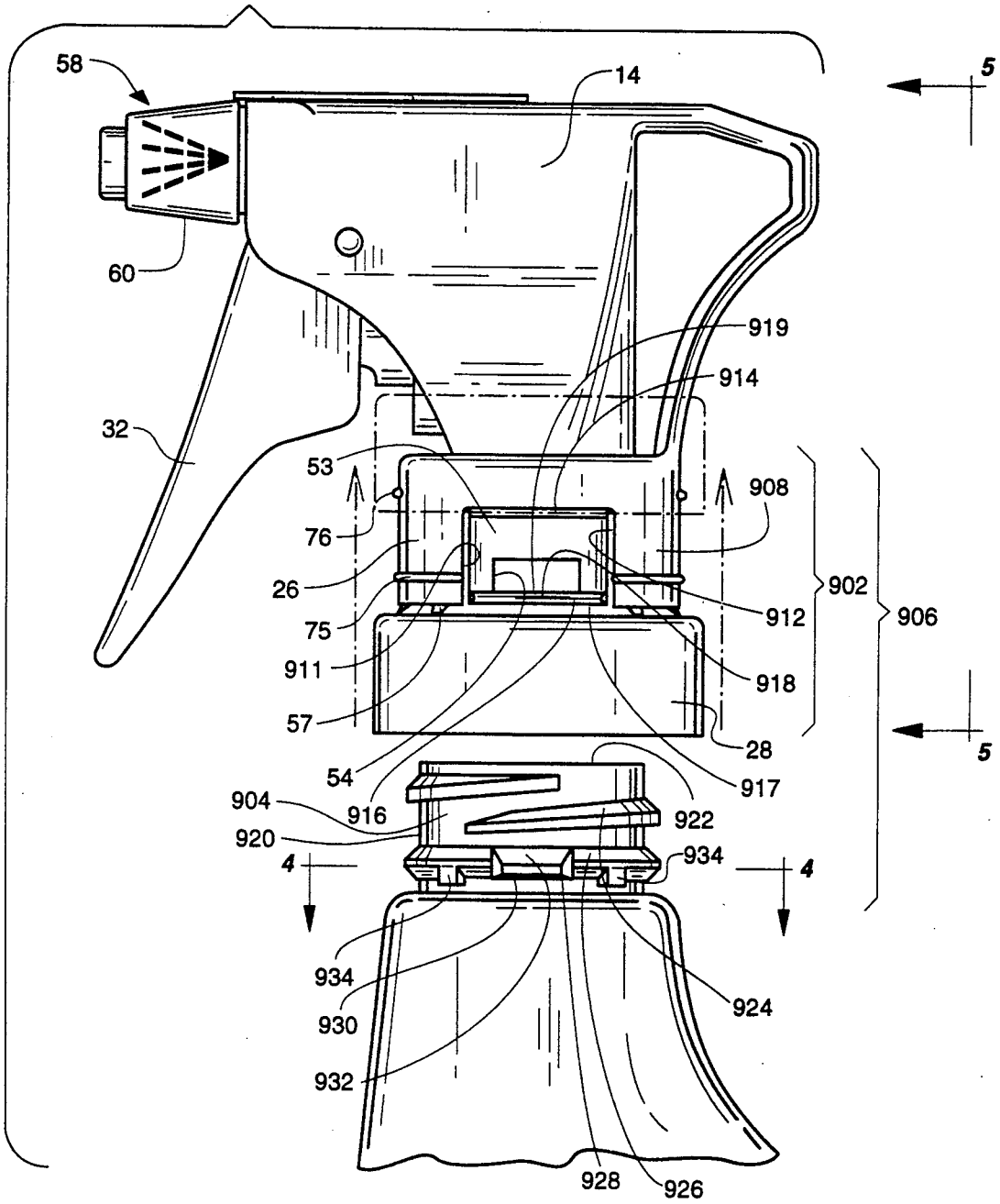
FIG. 3 is an exploded side elevational view of the trigger sprayer bottle cap/bottle neck assembly of the present invention including a quick-locking bottle cap assembly of the present invention positioned over a mating bottle neck.
Figure 4:
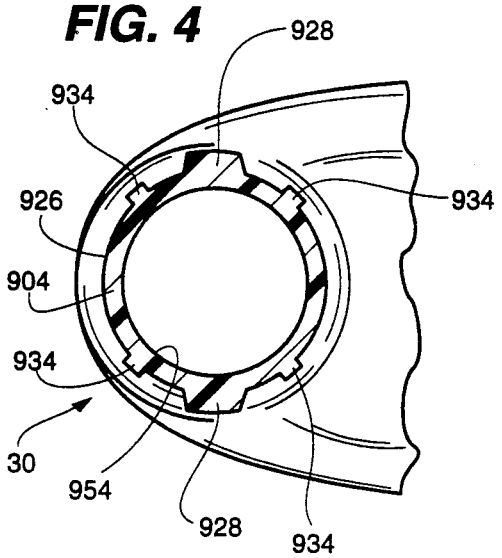
FIG. 4 is a horizontal sectional view through the bottle neck and is taken along line 4—4 of FIG. 3.
Figure 5:
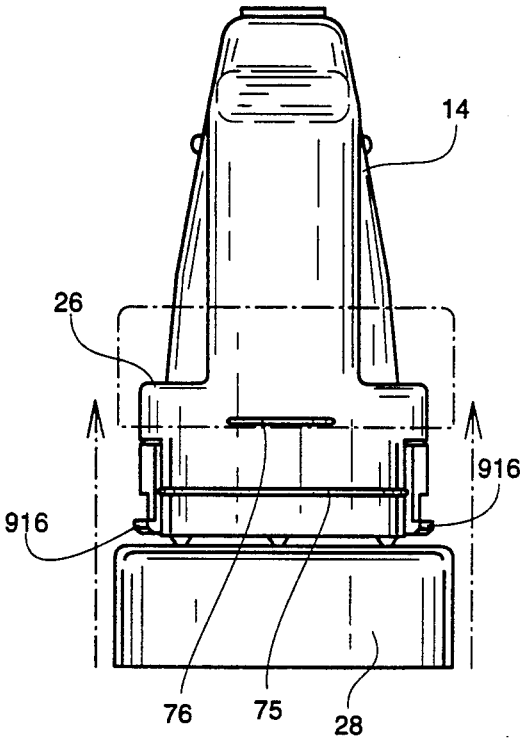
FIG. 5 is a rear elevational view of the trigger sprayer bottle cap assembly and is taken along line 5—5 of FIG. 3.

Referring now to FIG. 3, there is illustrated therein the locking ring 28 before it is detached from the cylindrical base 26 by breaking the fillets 57. The cylindrical base 26 and the locking ring 28 form a bottle cap assembly 902 constructed according to the teachings of the present invention which together with a tubular portion 904 of the bottle neck 30 form a bottle cap/bottle neck assembly 906.

The locking ring 28 is broken away by twisting same relative to the cylindrical base 26 and then is moved upwardly as indicated by the arrows and as shown in phantom frictionally engaging the locating rib segments 76. In this position, the cylindrical base 26 and the locking ring 28 are ready for being pressed downwardly upon the bottle neck 904 and the locking ring 28 temporarily is held in place by its frictional engagement with the rib segments 76.

As shown, the cylindrical base 26 has a cylindrical wall portion 908 having a pair of spaced apart upwardly extending slots 911 and 912 formed therein on each side of the sprayer body 14 so as to define therebetween two of the locking tabs 53. At the upper end of each locking tab 53 is a line area of reduced thickness 914 to provide a hinge 914 whereby each locking tab 53 can be flexed inwardly or outwardly relative to the cylindrical wall 908 of the cylindrical base 26.

The lug receiving opening 54 in each tab 53 is generally rectangular as shown. There is provided beneath the opening 54 on each locking tab 53 an outwardly extending flange 916 having an inclined lower surface 917 which inclines upwardly and outwardly from the bottom of the tab 53 to an outer surface 918. A top surface or shoulder 919 extends horizontally radially outwardly from the tab 53 to the outer surface 918 and faces upwardly.

The bottle neck 904 is generally tubular in shape and has an outer cylindrical surface 920 and an annular top edge 922. A conventional thread 924 is provided on the cylindrical outer surface 920.

Beneath the thread 924 on the outer cylindrical surface 920 is an annular rib 926 having, on diametrically opposite sides of the outer cylindrical surface 920, locking lugs 928 which are generally rectangular in shape with a lower horizontally extending shoulder 930 and an upper inclined surface 932 which inclines downwardly from the outer cylindrical surface 920. Each of the lugs 928 is generally rectangular in shape and located circumferentially to the side of and on each side of each lug 928 is a stop post 934 which can serve to locate the locking tabs 53 when they are pushed down over the locking lugs 928, but which are optional.

Figure 6:
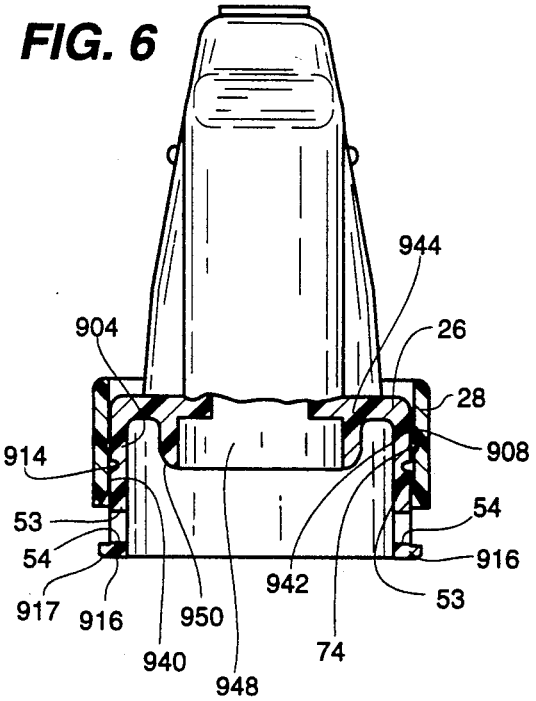
FIG. 6 is a rear elevational view, similar to FIG. 5, with portions broken away to show a sectional view through locking tabs formed in the cylindrical base, and shows a locking ring of the bottle cap assembly detached from a cylindrical base and moved upwardly on the cylindrical base.
Figure 7:
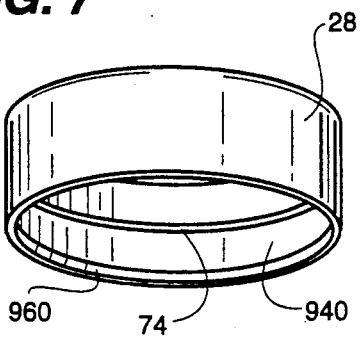
FIG. 7 is a perspective view of the locking ring.

As shown in FIGS. 6 and 7, the locking ring 28 has the annular groove 74 formed on the inner cylindrical surface 940 thereof. The groove 74 is adapted to receive the annular rib 75 in a snap-fitting cylindrical base 26.

As shown in FIG. 6, the cylindrical wall 908 of the base 26 has an inner cylindrical surface 942 which is received over the tubular portion 904 and which is typically unthreaded, as shown.

The cylindrical wall 908 extends to a top wall 944 of the cylindrical base 26. Inwardly of the cylindrical surface 942 is a sealing ring 948 which has a lower outer beveled edge 950 and which extends downwardly from the top wall 944 and is adapted to be received frictionally within tubular inner surface 954 of the tubular portion 904 of the bottle neck 30, as shown in FIG. 10.

Also as shown in FIGS. 6, 7 and 10, the locking ring 28 has a lower beveled or recessed inner surface 960 which is received over any protruding portion of the flanges 916 when the locking ring 28 is positioned over the tabs 53.

As shown in FIGS. 5, 6, 8, 9 and 10, the cylindrical base 26 with the locking ring 28 held in a raised position (FIG. 8) is pressed downwardly over the tubular portion 904 of the bottle neck 30 to press the sealing ring 948 within the inner surface 954 and at the same time push the tabs 53 downwardly over the inclined surface 932 of each of the locking lugs 928 until each locking lug 928 snaps into one of the openings 54 in one of the locking tabs 53. Then, the locking ring 28 is moved downwardly with the inner surface 940 thereof frictionally engaging the ribs 76 until the rib 75 is snap fittingly received in the annular groove 74 where the locking ring 28 is detachably locked in place against vertical movement of the locking ring 28 with the rib segments 76 being located adjacent the upper annular edge of the locking ring 28. This locking relationship is shown in FIGS. 9 and 10.

The bottle neck/bottle cap assembly 906 shown in FIGS. 9 and 10 provides a quick, push on, coupling of the bottle cap assembly 902 onto the bottle neck 30 and the engagement of the locking lugs 928 with the openings 54 in the locking tabs 53 prevents vertical movement of the cylindrical base 26 off of the bottle neck 30, locates the trigger sprayer 10 in a desired relationship with the bottle 12 and prevents relative rotational movement between the cylindrical base 26 and the bottle neck 30.

From the foregoing description, it will be apparent that the bottle cap assembly 902, the bottle neck 30 and the coupling bottle cap/bottle neck assembly 906 of the present invention have a number of advantages, some of which have been described above and others of which are inherent in the invention. In particular, it is very child resistant and a child rotating the locking ring 28 will not be able to disconnect the bottle cap/bottle neck assembly 906. Also, it will be apparent that modifications can be made to the bottle cap assembly 902, the bottle neck 30 and the bottle cap/bottle neck assembly 906 without departing from the teachings of the present invention. Accordingly, the scope of the invention is only to be limited as necessitated by the accompanying claims.

We claim:

1. A child resistant trigger sprayer bottle cap/bottle neck assembly comprising:

a trigger sprayer having a body including a cylindrical base;

first non-thread coupling means incorporated into said cylindrical base for coupling to a bottle neck;

a bottle neck;

second non-thread coupling means on said bottle neck adapted to engage and couple with said first coupling means;

a locking ring received over said cylindrical base and said cylindrical neck for maintaining said first and second coupling means in a coupled locked position; and, one of said coupling means including a laterally projecting element and the other of said coupling means including a latch formation having an opening for receiving said projecting element.

2. The assembly of claim 1 wherein said first coupling means comprises said latch formation which includes at least one locking tab formed in said cylindrical base and having said opening for locking with said second coupling means on said bottle neck.

3. The assembly of claim 2 wherein said cylindrical base includes a cylindrical wall having at least two spaced apart axially extending slots therein with the tab being defined between said slots.

4. The assembly of claim 3 wherein the top of said at least one tab is defined by a line of reduced thickness material in said cylindrical wall forming a hinge for said tab.

5. The assembly of claim 3 wherein said at least one tab has said opening therein and said second coupling means on said bottle neck comprises said projecting element which is defined by at least one locking lug that extends outwardly from said bottle neck for being received in said opening in said at least one locking tab.

6. The assembly of claim 5 wherein said at least one locking lug has an upper surface that extends downwardly from the bottle neck forming a ramp surface past which said tab can be pushed until said locking lug is snap fittingly received in said opening in said locking tab.

7. The assembly of claim 6 wherein said locking tab has a radially outwardly extending flange at a lower side thereof beneath said opening, said flange being received under and locking with said at least one locking lug.

8. The assembly of claim 7 wherein said locking ring has a lower inner beveled surface which is received over said flange on said at least one tab.

9. The assembly of claim 1 wherein said cylindrical base has an annular rib on an outer cylindrical surface thereof and said locking ring has an annular groove therein which is adapted to receive said annular rib in a snap-fitting manner when said locking ring is moved down over said cylindrical base to detachably lock said locking ring on said cylindrical base and over said first and second coupling means thereby detachably locking the locking ring against axial movement relative to said cylindrical base.

10. The assembly of claim 1 wherein said first coupling means includes said opening in said latch formation which is a deflectable portion of said cylindrical base and said second coupling means includes said projecting element which is defined by a locking lug extending outwardly from said bottle neck and adapted to be received in said opening.

11. The assembly of claim 10 wherein said bottle neck has on either side of and spaced from said locking lug a locating post on the periphery of said bottle neck.

12. The assembly of claim 1 wherein said bottle neck has a thread formation on the outer surface thereof above said second coupling means whereby said bottle neck is adapted to receive a conventional screw thread bottle cap.

13. The assembly of claim 1 wherein said cylindrical base has an outer cylindrical surface with at least two rib segments thereon past which the locking ring can be pushed axially upwardly while frictionally engaging said rib segments and after said cylindrical base is pressed downwardly over said bottle neck said locking ring can be moved downwardly past said rib segments and over said coupled and locked first and second coupling means to a position just beneath said locating rib segments.

14. The assembly of claim 1 wherein said cylindrical base includes a cylindrical wall and a top wall and wherein a sealing ring having a lower outer bevelled edge extends downwardly from said top wall and is adapted to be received within the inner surface of said bottle neck.

15. The assembly of claim 1 wherein said cylindrical base includes a cylindrical wall and said first coupling means includes said latch formation which is defined first and second diametrically opposed locking tabs formed in said cylindrical wall and having and said coupling means on said bottle neck comprises said projecting element which is defined by first and second diametrically opposed locking lugs on said bottle neck adapted to couple and lock with said opening of said latch formation.

16. A method for locking a trigger sprayer to a bottle neck of a liquid storage container, said method comprising the steps of:

providing at the lower end of a trigger sprayer a cylindrical base including a cylindrical wall;

providing in said cylindrical wall first coupling means for coupling with a bottle neck;

providing on the bottle neck second coupling means for coupling and locking with the first coupling means;

molding with the cylindrical base a locking ring which is detachably connected to the cylindrical base at a lower edge of the cylindrical wall of the cylindrical base;

breaking the locking ring away from the cylindrical base and moving it upwardly on the cylindrical base;

pushing the cylindrical base downwardly over the bottle neck until the first coupling means couples and locks with the second coupling means; and, pushing the locking ring downwardly over the cylindrical base and the coupled and locked first and second coupling means.

17. A child resistant trigger sprayer bottle cap/bottle neck assembly comprising:

a trigger sprayer having a body including a cylindrical base;

first coupling means incorporated into said cylindrical base for coupling to a bottle neck;

a bottle neck;

second coupling means on said bottle neck adapted to engage and couple with said first coupling means;

said first coupling means comprising at least one locking tab formed in said cylindrical base and having means for locking with said second coupling means on said bottle neck; and, a locking ring received over said cylindrical base and said cylindrical neck for maintaining said first and second coupling means in a coupled locked position.

18. The assembly of claim 17 wherein said cylindrical base includes a cylindrical wall having at least two spaced apart axially extending slots therein with the tab being defined between said slots.

19. The assembly of claim 18 wherein the top of said at least one tab is defined by a line of reduced thickness material in said cylindrical wall forming a hinge for said tab.

20. The assembly of claim 17 wherein said at least one tab has an opening therein defining said locking means and said second coupling means on said bottle neck is defined by at least one locking lug that extends outwardly from said bottle neck for being received in said opening in said at least one locking tab.

21. The assembly of claim 20 wherein said at least one locking lug has an upper surface that extends downwardly from the bottle neck forming a ramp surface past which said tab can be pushed until said locking lug is snap fittingly received in said opening in said locking tab.

22. The assembly of claim 21 wherein said locking tab has a radially outwardly extending flange at a lower side thereof beneath said opening, said flange being received under and locking with said at least one locking lug.

23. The assembly of claim 22 wherein said locking ring has a lower inner beveled surface which is received over said flange on said at least one tab.

24. The assembly of claim 17 wherein said cylindrical base has an annular rib on an outer cylindrical surface thereof and said locking ring has an annular groove therein which is adapted to receive said annular rib in a snap-fitting manner when said locking ring is moved down over said cylindrical base to detachably lock said locking ring on said cylindrical base and over said first and second coupling means thereby detachably locking the locking ring against axial movement relative to said cylindrical base.

25. The assembly of claim 17 wherein said locking tab of said first coupling means has an opening defining said locking means located in a deflectable portion of said locking tab and said second coupling means includes a locking lug defining said second coupling means, extending outwardly from said bottle neck and adapted to be received in said opening.

26. The assembly of claim 25 wherein said bottle neck has on either side of and spaced from said locking lug a locating post on the periphery of said bottle neck.

27. The assembly of claim 17 wherein said bottle neck has a thread formation on the outer surface thereof above said second coupling means wherein said bottle neck is adapted to receive a conventional screw thread bottle cap.

28. The assembly of claim 17 wherein said cylindrical base has an outer cylindrical surface with at least two rib segments thereon past which the locking ring can be pushed axially upwardly while frictionally engaging said rib segments and after said cylindrical base is pressed downwardly over said bottle neck said locking ring can be moved downwardly past said rib segments and over said coupled and locked first and second coupling means to a position just beneath said locating rib segments.

29. The assembly of claim 17 wherein said cylindrical base includes a cylindrical wall and a top wall and wherein a sealing ring having a lower outer bevelled edge extends downwardly from said top wall and is adapted to be received within the inner surface of said bottle neck.

30. A child resistant trigger sprayer bottle cap/bottle neck assembly comprising:

a trigger sprayer having a body including a cylindrical base;

first coupling means incorporated into said cylindrical base for coupling to a bottle neck;

a bottle neck;

second coupling means on said bottle neck adapted to engage and couple with said first coupling means;

said first coupling means including an opening n a deflectable portion of said cylindrical base and said second coupling means including a locking lug extending outwardly from said bottle neck and adapted to be received in said opening; and, a locking ring received over said cylindrical base and said cylindrical neck for maintaining said first and second coupling means in a coupled locked position.

31. The assembly of claim 30 wherein said cylindrical base has an annular rib on an outer cylindrical surface thereof and said locking ring has an annular groove therein which is adapted to receive said annular rib in a snap-fitting manner when said locking ring is moved down over said cylindrical base to detachably lock said locking ring on said cylindrical base and over said first and second coupling means thereby detachably locking the locking ring against axial movement relative to said cylindrical base.

32. The assembly of claim 31 wherein said bottle neck has on either side of and spaced from said locking lug a locating post on the periphery of said bottle neck.

33. The assembly of claim 30 wherein said bottle neck has a thread formation on the outer surface thereof above said second coupling means whereby said bottle neck is adapted to receive a conventional screw thread bottle cap.

34. The assembly of claim 30 wherein said cylindrical base has an outer cylindrical surface with at least two rib segments thereon past which the locking ring can be pushed axially upwardly while frictionally engaging said rib segments and after said cylindrical base is pressed downwardly over said bottle neck said locking ring can be moved downwardly past said rib segments and over said coupled and locked first and second coupling means to a position just beneath said locating rib segments.

35. The assembly of claim 30 wherein said cylindrical base includes a cylindrical wall and a top wall and wherein a sealing ring having a lower outer bevelled edge extends downwardly from said top wall and is adapted to be received within the inner surface of said bottle neck.

36. A child resistant trigger sprayer bottle cap/bottle neck assembly comprising:

a trigger sprayer having a body including a cylindrical base;

first coupling means incorporated into said cylindrical base for coupling to a bottle neck;

a bottle neck;

second coupling means on said bottle neck adapted to engage and couple with said first coupling means;

a locking ring received over said cylindrical base and said cylindrical neck for maintaining said first and second coupling means in a coupled locked position; and, said bottle neck having a thread formation on the outer surface thereof above said second coupling means whereby said bottle neck is adapted to receive a conventional screw thread bottle cap.

37. The assembly of claim 36 wherein said first coupling means comprises at least one locking tab formed in said cylindrical base and having means for locking with said second coupling means on said bottle neck.

38. The assembly of claim 37 wherein said cylindrical base includes a cylindrical wall having at least two spaced apart axially extending slots therein with the tab being defined between said slots.

39. The assembly of claim 38 wherein the top of said at least one tab is defined by a line of reduced thickness material in said cylindrical wall forming a hinge for said tab.

40. The assembly of clam 37 wherein said at least one tab has an opening therein defining said locking means and said second coupling means on said bottle neck is defined by at last one locking lug that extends outwardly from said bottle neck for being received in said opening in said at least one locking tab.

41. The assembly of claim 40 wherein said at least one locking lug has an upper surface that extends downwardly from the bottle neck forming a ramp surface past which said tab can be pushed until said locking lug is snap fittingly received in said opening in said locking tab.

42. The assembly of claim 41 wherein said locking tab has a radially outwardly extending flange at a lower side thereof beneath said opening, said flange being received under and locking with said at least one locking lug.

43. The assembly of claim 42 wherein said locking ring has a lower inner beveled surface which is received over said flange on said at least one tab.

44. The assembly of claim 36 wherein said cylindrical base has an annular rib on an outer cylindrical surface thereof and said locking ring has an annular groove therein which is adapted to receive said annular rib in a snap-fitting manner when said locking ring is moved down over said cylindrical to detachably lock said locking ring on said cylindrical base and over said first and second coupling means thereby detachably locking the locking ring axial movement relative to said cylindrical base.

45. The assembly of claim 36 wherein said first coupling means includes an opening in a deflectable portion of said cylindrical base and said second coupling means includes a locking lug extending outwardly from said bottle neck and adapted to be received in said opening.

46. The assembly of claim 45 wherein said bottle neck has on either side of and spaced from said locking lug a locating post on the periphery of said bottle neck.

47. The assembly of claim 36 wherein said cylindrical base has an outer cylindrical surface with at least two rib segments thereon past which the locking ring can be pushed axially upwardly while frictionally engaging said rib segments and after said cylindrical base is pressed downwardly over said bottle neck said locking ring can be moved downwardly past said rib segments and over said coupled and locked first and second coupling means to a position just beneath said locating rib segments.

48. The assembly of claim 36 wherein said cylindrical base includes a cylindrical wall and a top wall and wherein a sealing ring having a lower outer bevelled edge extends downwardly from said top wall and is adapted to be received within the inner surface of said bottle neck.

49. The assembly of claim 36 wherein said cylindrical base includes a cylindrical wall and said first coupling means includes first and second diametrically opposed locking tabs formed in said cylindrical wall and having bottle neck engaging means thereon and said coupling means on said bottle neck comprises first and second diametrically opposed locking lugs on said bottle neck adapted to couple and lock with said engaging means on said locking tabs.

50. A trigger sprayer having a body including a cylindrical base;

first coupling means incorporated into said cylindrical base for coupling to a bottle neck;

a bottle neck;

second coupling means on said bottle neck adapted to engage and couple with said first coupling means;

a locking ring received over said cylindrical base and said cylindrical neck for maintaining said first and second coupling means in a coupled locked position; and, said cylindrical base having an outer cylindrical surface with at least two rib segments thereon past which the locking ring can be pushed axially upwardly while frictionally engaging said rib segments and after said cylindrical base is pressed downwardly over said bottle neck said locking ring can be moved downwardly past said rib segments and over said coupled and locked first and second coupling means to a position just beneath said locating rib segments.

51. The assembly of claim 50 wherein said first coupling means comprises at least one locking tab formed in said cylindrical base and having means for locking with said second coupling means on said bottle neck.

52. The assembly of claim 51 wherein said cylindrical base includes a cylindrical wall having at least two spaced apart axially extending slots therein with the tab being defined between said slots.

53. The assembly of claim 52 wherein the top of said at least one tab is defined by a line of reduced thickness material in said cylindrical wall forming a hinge for said tab.

54. The assembly of claim 51 wherein said at least one tab has an opening therein defining said locking means and said second coupling means on said bottle neck is defined by at least one locking lug that extends outwardly from said bottle neck for being received in said opening in said at least one locking tab.

55. The assembly of claim 54 wherein said at least one locking lug has an upper surface that extends downwardly from the bottle neck forming a ramp surface past which said tab can be pushed until said locking lug is snap fittingly received in said opening in said locking tab.

56. The assembly of claim 55 wherein said locking tab has a radially outwardly extending flange at a lower side thereof beneath said opening, said flange being received under and locking with said at least one locking lug.

57. The assembly of claim 56 wherein said locking ring has a lower inner beveled surface which is received over said flange on said at least one tab.

58. The assembly of claim 50 wherein said cylindrical base has an annular rib on an outer cylindrical surface thereof and said locking ring has an annular groove therein which is adapted to receive said annular rib in a snap-fitting manner when said locking ring is moved down over said cylindrical base to detachably lock said locking ring on said cylindrical base and over said first and second coupling means thereby detachably locking the locking ring against axial movement relative to said cylindrical base.

59. The assembly of claim 50 wherein said first coupling means includes an opening in a deflectable portion of said cylindrical base and said second coupling means includes a locking lug extending outwardly from said bottle neck and adapted to be received in said opening.

60. The assembly of claim 59 wherein said bottle neck has on either side of and spaced from said locking lug a locating post on the periphery of said bottle neck.

61. The assembly of claim 50 wherein said bottle neck has a thread formation on the outer surface thereof above said second coupling means whereby said bottle neck is adapted to receive a conventional screw thread bottle cap.

62. The assembly of claim 50 wherein said cylindrical base includes a cylindrical wall and a top wall and wherein a sealing ring having a lower outer bevelled edge extends downwardly from said top wall and is adapted to be received within the inner surface of said bottle neck.

63. The assembly of claim 50 wherein said cylindrical base includes a cylindrical wall and said first coupling means includes first and second diametrically opposed locking tabs formed in said cylindrical wall and having bottle neck engaging means thereon and said coupling means on said bottle neck comprises first and second diametrically opposed locking lugs on said bottle neck adapted to couple and lock with said engaging means on said locking tabs.

64. A child resistant trigger sprayer bottle cap/bottle neck assembly comprising:

a trigger sprayer having a body including a cylindrical base;

first coupling means incorporated into said cylindrical base for coupling to a bottle neck;

a bottle neck;

second coupling means on said bottle neck adapted to engage and couple with said first coupling means;

a locking ring received over said cylindrical base and said cylindrical neck for maintaining said first and second coupling means in a coupled locked position: and, said cylindrical base including a cylindrical wall and said first coupling means includes first and second diametrically opposed locking tabs formed in said cylindrical wall and having bottle neck engaging means thereon and said second coupling means on said bottle neck comprises first and second diametrically opposed locking lugs on said bottle neck adapted to couple and lock with said engaging means on said locking tabs.

65. The assembly of claim 64 wherein said cylindrical base has an annular rib on an outer cylindrical surface thereof and said locking ring has an annular groove therein which is adapted to receive said annular rib in a snap-fitting manner when said locking ring is moved down over said cylindrical base to detachably lock said locking ring on said cylindrical base and over said locking ring on said cylindrical base and over said first and second coupling means thereby detachably locking the locking ring against axial movement relative to said cylindrical base.

66. The assembly of claim 64 wherein said cylindrical base has an outer cylindrical surface with at least two rib segments thereon past which the locking ring can be pushed axially upwardly while frictionally engaging said rib segments and after said cylindrical base is pressed downwardly over said bottle neck said locking ring can be moved downwardly past said rib segments and over said coupled and locked first and second coupling means to a position just beneath said locating rib segments.

67. The assembly of claim 64 wherein said cylindrical base includes a cylindrical wall and atop wall and wherein a sealing ring having a lower outer bevelled edge extends downwardly from said top wall and is adapted to be received within the inner surface of said bottle neck.

68. A trigger sprayer adapted to be coupled to a bottle neck of a liquid storage container, said trigger sprayer comprising a body including a cylindrical base having a cylindrical wall, coupling means incorporated into said cylindrical wall for coupling to a bottle neck, and a locking ring which is molded with said cylindrical base and which is detachably connected to said cylindrical base at a lower edge of said cylindrical wall of said cylindrical base.

* * * * *

UNITED STATES PATENT AND TRADEMARK OFFICE

CERTIFICATE OF CORRECTION

PATENT NO. : 5,238,152

DATED : August 24, 1993

INVENTOR(S) : Wilhemus J. J. Maas and Petrus L.W. Hurkmans

It is certified that error appears in the above-indentified patent and that said Letters Patent is hereby corrected as shown below:

Column 2, line 52 "to as" should be --to a--.

Column 3, line 47 "FIG. a" should be --FIG. 1 a--.

Column 5, line 57 insert after "snapfitting" --manner when the locking ring 28 is moved down over--.

Column 9, line 38 "wherein" should be --whereby--.

Column 9, line 66 "n a" should be --in a--.

Column 11, line 6 "last" should be --least--.

UNITED STATES PATENT AND TRADEMARK OFFICE

CERTIFICATE OF CORRECTION

PATENT NO. : 5,238,152

DATED : August 24, 1993

INVENTOR(S) : Wilhemus J. J. Maas and Petrus L.W. Hurkmans

It is certified that error appears in the above-indentified patent and that said Letters Patent is hereby corrected as shown below:

Column 11, line 28 "cylindrical to" should be —cylindrical base to—.

Column 11, line 32 "ring axial" should be --ring against axial—.

Column 11, line 67 "50. A trigger" should be
—50. A child resistant trigger sprayer bottle cap/bottle neck assembly comprising:
a trigger—

Column 14, lines 11-12 after "said" delete —locking ring on said cylindrical base and over said—.

Column 14, line 27 "atop" should be --a top--.

Signed and Sealed this

Fourteenth Day of June, 1994

Bruce Lehman

*Attest:*

BRUCE LEHMAN

*Attesting Officer*

*Commissioner of Patents and Trademarks*